US006419756B1

(12) United States Patent
Schlechter

(10) Patent No.: US 6,419,756 B1
(45) Date of Patent: Jul. 16, 2002

(54) PROCESS AND EQUIPMENT FOR PICKLING A METAL STRIP

(75) Inventor: Wilfried Schlechter, Hoechstadt (DE)

(73) Assignee: Siemens Aktiengellschaft, Munich (DE)

( * ) Notice: Subject to any disclaimer, the term of this patent is extended or adjusted under 35 U.S.C. 154(b) by 0 days.

(21) Appl. No.: 09/509,163

(22) PCT Filed: Sep. 16, 1998

(86) PCT No.: PCT/DE98/02747

§ 371 (c)(1),
(2), (4) Date: Jun. 1, 2000

(87) PCT Pub. No.: WO99/16933

PCT Pub. Date: Apr. 8, 1999

(30) Foreign Application Priority Data

Sep. 29, 1997 (DE) ..... 197 43 022

(51) Int. Cl.[7] ..... B08B 1/02; B08B 7/04

(52) U.S. Cl. ..... 134/15; 134/18; 134/42; 134/113; 134/122 R; 266/112

(58) Field of Search ..... 134/42, 15, 18, 134/64 R, 122 R, 113; 266/112

(56) References Cited

U.S. PATENT DOCUMENTS 3,622,140 A * 11/1971 Schwestka et al. ..... 266/3 R
3,623,532 A * 11/1971 Cofer et al. ..... 134/3
4,325,746 A 4/1982 Popplewell et al. ..... 134/10
4,338,282 A * 7/1982 Motooka et al. ..... 134/15
4,872,245 A * 10/1989 Kawasaki et al. ..... 134/63
5,800,694 A * 9/1998 Starcevic et al. ..... 205/705
6,264,757 B1 * 7/2001 Lester et al. ..... 134/15

FOREIGN PATENT DOCUMENTS

| | | |
|---|---|---|
| DE | 196 02 303 | 8/1996 |
| EP | 0 195 385 | 9/1986 |
| EP | 0 204 846 | 12/1986 |
| GB | 1003454 | 9/1965 |

* cited by examiner

*Primary Examiner*—Randy Gulakowski
*Assistant Examiner*—Saeed Chaudhry
(74) *Attorney, Agent, or Firm*—BakerBotts LLP

(57) ABSTRACT

Process and equipment for pickling a metal strip, in particular a rolled strip, by means of a pickling plant, through which the metal strip passes and in which the metal strip is pickled using a pickling liquid, the pickling result being a function of pickling parameters. The pickling result is measured and at least one pickling parameter is automatically varied, as a function of the measurement of the pickling result, so as to improve the pickling result.

10 Claims, 2 Drawing Sheets

PROCESS AND EQUIPMENT FOR PICKLING A METAL STRIP

FIELD OF THE INVENTION

The present invention relates to a process and to equipment for pickling a metal strip, in particular a rolled strip, by means of a pickling plant, through which the metal strip passes and in which the metal strip is pickled using a pickling liquid, the pickling result being a function of pickling parameters.

BACKGROUND INFORMATION

In order to clean metal strips, in particular in order to remove scale layers on rolled strips, the metal strips are pickled in a pickling plant using a pickling liquid, generally acid. The amount removed by the pickling is a function of pickling parameters. These are, for example: temperature of the pickling liquid, speed at which the metal strip passes through the pickling plant, the acid content in the pickling liquid, the metal content in the pickling liquid, in particular the iron content in the pickling liquid, strip parameters, such as material and geometric dimensions, and the turbulent pressure of the pickling liquid. These pickling parameters have to be set in such a way that as far as possible, the desired amount of material is removed from the metal strip. Deviations from the desired optimum value are associated with high costs. If too much material is removed, i.e., if it is not only the scale layer that is removed from a rolled strip but also metal from the surface of the rolled strip, then the metal or iron content in the pickling liquid is increased to a disproportionate extent. Since the purification of the pickling liquid is complicated and expensive, too high a removal rate is undesirable. In addition, in the event of too high a removal rate, damage to the metal strip may occur. On the other hand, if too much material, in particular too much scale, remains on the metal strip, then this has to pass through the pickling plant again. This additional operation is complicated and expensive.

Setting the pickling parameters to achieve the best possible pickling result is conventionally carried out, by an operator of the pickling plant. However, this leads to fluctuations in the pickling result. The pickling result is to be understood, for example, as the amount of material removed or the amount of scale that has remained on the metal strip.

SUMMARY

An object of the present invention is to provide a process and equipment for pickling a metal strip by means of which the pickling result is improved. Furthermore, it is desirable to reduce the costs for the pickling of a metal strip.

According to the present invention, the pickling result is measured and at least one pickling parameter is automatically varied, as a function of the measurement of the pickling result, so as to improve the pickling result. The automatic variation allows the setting of the corresponding pickling parameter by an operator to be dispensed with. In this way, a more constant and better pickling result is achieved. A saving is also made in corresponding operating personnel. The pickling parameters to be set include, for example, the temperature of the pickling liquid in the pickling plant, which is determined, for example, from the temperature of the pickling liquid in the feed into the pickling plant and the temperature of the pickling liquid in the discharge from the pickling plant, the speed of the metal strip, the acid parameters of the pickling liquid, the iron concentration in the pickling liquid, the turbulent pressure of the pickling liquid in the pickling plant and the properties of the metal strip, such as its material and its geometric dimensions. In this case, the temperature of the pickling liquid is the pickling parameter that is particularly suitable for automatic setting. Since the temperature of the pickling liquid in the pickling plant is difficult to measure and difficult to control, use is advantageously made of the feed temperature of the pickling liquid into the pickling plant, the discharge temperature of the pickling liquid from the pickling plant or both temperatures instead of the temperature of the pickling liquid in the pickling plant.

The pickling result is advantageously measured by measuring defects and/or unpickled points on the metal strip. The defects and/or unpickled points are advantageously classified and counted. The classification of the defects and/or unpickled points is in this case advantageously carried out in relation to their size and/or their shape. The defects and/or unpickled points classified and counted in this way are advantageously evaluated. The evaluation is carried out using a fuzzy evaluator, a neural network or evaluator a neural fuzzy assessor. However, the measured values can also be evaluated directly, that is to say unclassified, by a fuzzy evaluated, a neural network or a neural fuzzy evaluated, but indirect evaluation, that is to say the evaluation of the classified and counted defects and/or unpickled points, is more advantageous. The result of the evaluation using a fuzzy evaluator, a neural network or a neural fuzzy evaluator are set points for at least one pickling parameter.

DETAILED DESCRIPTION

Figure 1:
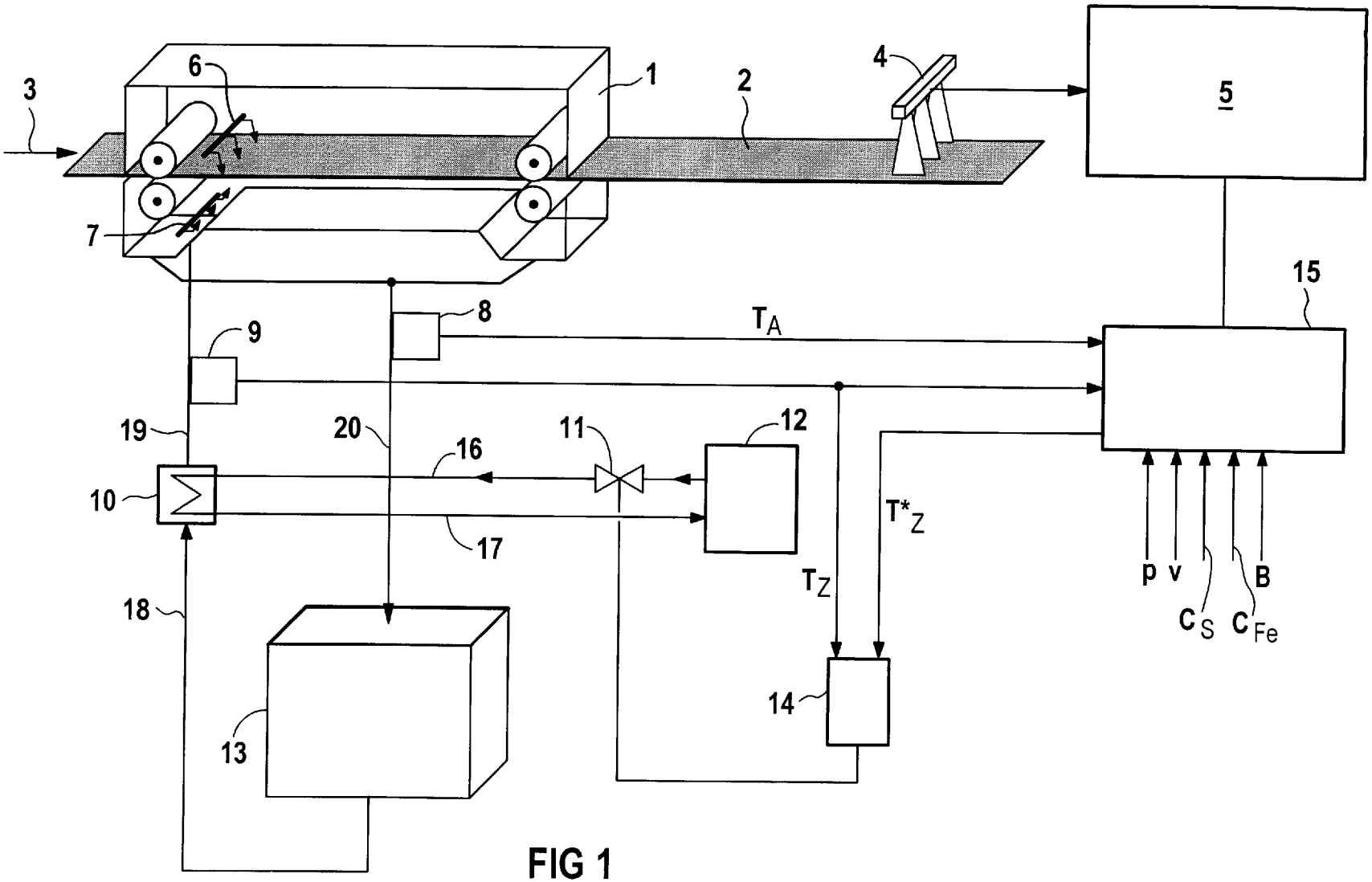
FIG. 1 shows a strip plant operated in accordance with the present invention.

In FIG. 1, reference symbol 1 designates a pickling plant, through which a metal strip 2 passes in the direction of the arrow designated by reference symbol 3. The metal strip 2 is pickled in the pickling plant 1, using a pickling liquid. The pickling liquid is fed to the pickling plant 1 from a pickling liquid tank 13 via feed lines 18, 19 and a heat exchanger 10. For the purpose of pickling, the pickling liquid is sprayed against the metal strip 2 from nozzles 6, 7. The pickling liquid running away is intercepted and fed to the pickling liquid tank 13 via a line 20.

The heat exchanger 10 is used for heating the pickling liquid. For this purpose, steam from a steam generator 12 is fed to the heat exchanger 10 via a steam line 16. The amount of steam can be set via a valve 11. The steam condenses in the heat exchanger 10. The water thus produced is fed to the steam generator 12 via a condensate line 17.

The pickling result, i.e. the amount of material removed, or the amount of undesired material, such as scale, for example, that has remained on the metal strip 2, is a function of pickling parameters. These pickling parameters may be, for example, the temperature of the pickling liquid in the pickling plant 1, the speed v of the metal strip 1, the acid parameters $c_s$ of the pickling liquid, the iron concentration $c_{Fe}$ in the pickling liquid, the turbulent pressure p of the pickling liquid in the pickling plant 1 and the properties B of the metal strip, such as its material and its geometric dimensions. In the present exemplary embodiment, the temperature of the pickling liquid is the only pickling parameter influenced. This is a particularly advantageous configuration, but the pickling result is improved further if further pickling parameters are set in a similar fashion.

The temperature $T_Z$ of the pickling liquid in the feed and the temperature $T_A$ of the pickling liquid in the discharge are measured using temperature measuring instruments 9 and 8.

The pickling result is measured by means of an optical measuring instrument 4. The signal from the measuring instrument 4 is fed to a classifier 5, in which defects on the metal strip 2 or unpickled points of a material to be pickled away, such as scale, for example, are classified and counted. The defects or points of unremoved material may be classified, for example, in accordance with the defect categories "hole", "dart spot", "light spot", "long dark stripes", "long bright stripes", "short dark stripes" and "short light stripes", in accordance with the following table:

| | Definition as a function of the speed | | | |
|---|---|---|---|---|
| Defect categories | v = 360 m/min | v = 600 m/min | v = 1400 m/min | v = any |
| Hole | Ø ≧ 0.25 mm | Ø ≧ 0.3 mm | Ø > 0.75 mm | — |
| Dark spot | Ø ≧ 0.85 mm | Ø ≧ 1.0 mm | Ø > 1.75 mm | — |
| Light spot | Ø ≧ 0.85 mm | Ø ≧ 1.0 mm | Ø > 1.75 mm | — |
| Long dark stripes (low contrast) | Width ≧0.25 mm Length ≧3 m | Width ≧0.25 mm Length ≧5 m | Width ≧0.25 mm Length ≧10 m | ≧0.25 mm |
| Long bright stripes (low contrast) | Width ≧0.25 mm Length ≧3 m | Width ≧0.25 mm Length ≧5 m | Width ≧0.25 mm Length ≧10 m | ≧0.25 mm |
| Short dark stripes (high contrast) | Width ≧0.25 mm Length ≧15 m | Width ≧0.25 mm Length ≧20 m | Width ≧0.25 mm Length ≧30 m | — |
| Short bright stripes (high contrast) | Width ≧0.25 mm Length ≧15 m | Width ≧0.25 mm Length ≧20 m | Width ≧0.25 mm Length ≧30 m | — |

The frequencies of the individual defect categories are fed to an evaluator 15. This ascertains a set point $T_Z^{\bigstar}$ for the temperature of the pickling liquid in the feed from the frequencies of the defect categories, from the temperature $T_A$ of the pickling liquid in the discharge, the temperature $T_Z$ of the pickling liquid in the feed, the speed v of the metal strip 2, the acid parameters $c_s$ of the pickling liquid, the iron concentration $c_{Fe}$ in the pickling liquid, the turbulent pressure p of the pickling liquid and the properties B of the metal strip 2.

The evaluator 15 is advantageously designed as a fuzzy evaluator, as a neural network or as a neural fuzzy evaluator. In this case, the neural fuzzy evaluator considered is advantageously a neural fuzzy system according to the article "Neuro-Fuzzy", H.-P. Preuβ, V. Tresp, VDI-Berichte 113, ISBN 3-18-091113-1, 1994, pages 89 to 122.

The set points $T_Z^{\bigstar}$ for the temperature of the pickling liquid in the feed are fed to a controller 14, which sets the valve 11 as a function of the temperature $T_Z$ of the pickling liquid in the feed and the set point $T_Z^{\bigstar}$ of the temperature of the pickling liquid in the feed.

Figure 2:
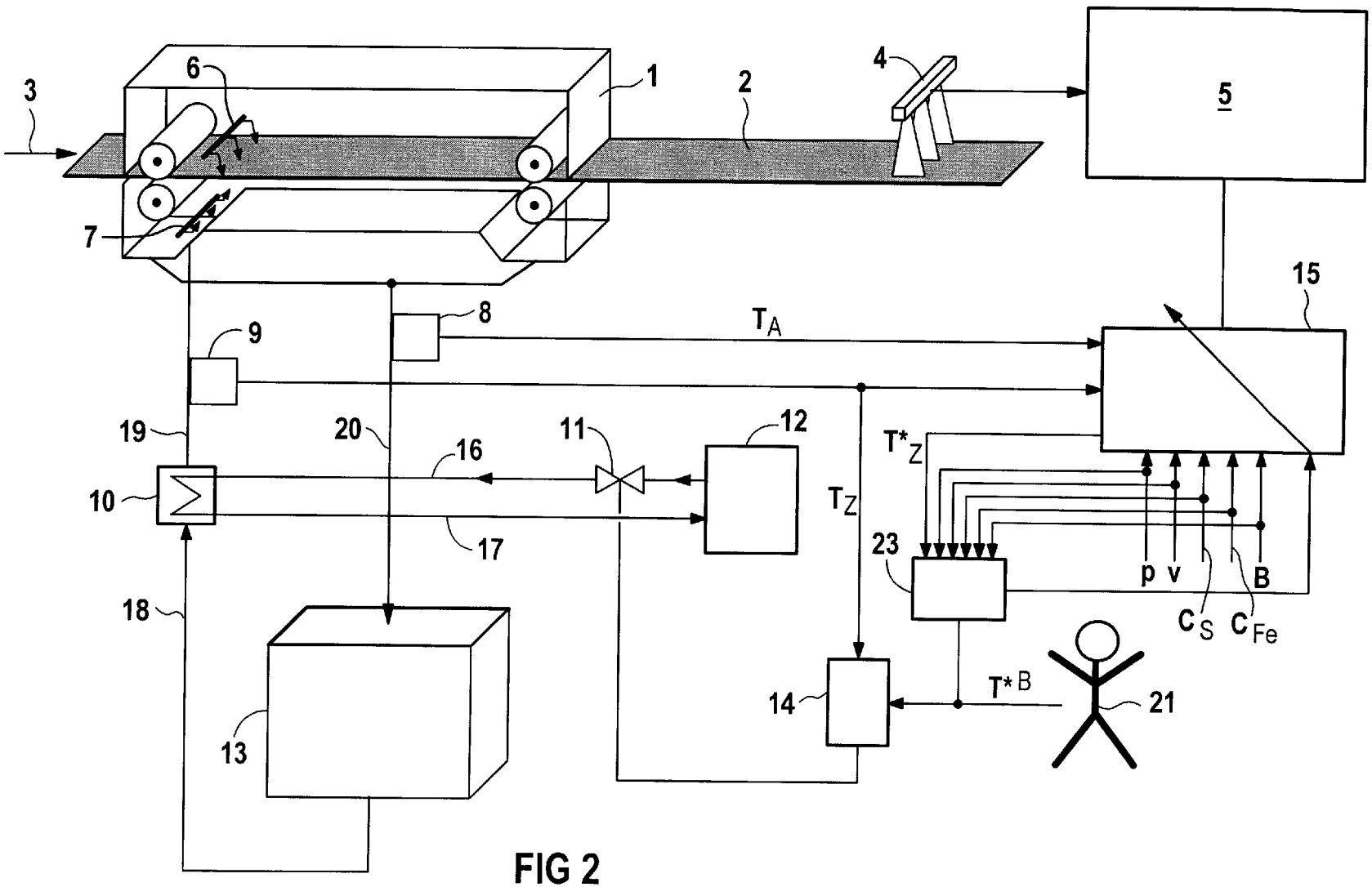
FIG. 2 shows an arrangement for training an assessor.

FIG. 2 shows equipment similar to that in FIG. 1. However, a set point $T_Z\bigstar^B$ is predefined for the controller 14 by an operator 21. The set point $T_Z\bigstar$ of the temperature of the pickling liquid in the feed, which is ascertained by the evaluator 15, does not go into the controller 14. The equipment according to FIG. 2 has a learning algorithm 23, by means of which the evaluator 15 ascertains a set point for the temperature in the feed as a function of the set point $T_Z\bigstar$ of the temperature of the pickling liquid in the feed, which is ascertained by the evaluator 15, of the set point $T_Z\bigstar^B$ of the temperature of the pickling liquid in the feed, which is ascertained by the operator 21, and as a function of further pickling parameters: temperature $T_Z$ of the pickling liquid in the feed, temperature $T_A$ of the pickling liquid in the discharge, the speed v of the metal strip 2, the acid parameters $C_s$ of the pickling liquid, the iron concentration $c_{Fe}$ in the pickling liquid, the turbulent pressure p of the pickling liquid in the pickling plant and the properties B of the metal strip 2.

What is claimed is:

1. A method for pickling a metal strip, comprising passing the metal strip through a pickling plant whereby the metal strip is pickled by a pickling liquid; measuring a pickling result, the pickling result being a function of pickling parameters and measured by measuring defects including unpickled points on the metal strip; and automatically changing at least one of the pickling parameters to improve the pickling results.

2. The method according to claim 1, wherein the at least one of the pickling parameters includes a temperature of the pickling liquid in a pickling liquid feed, a temperature of the pickling liquid in a pickling liquid discharge, a speed of the metal strip, acid parameters of the pickling liquid, iron concentration in the pickling liquid, and a turbulent pressure of the pickling liquid.

3. The method according to claim 1, wherein the at least one of the pickling parameters changed is a temperature of the pickling liquid.

4. The method according to claim 1, wherein the defects on the metal are classified and counted.

5. The method according to claim 1, wherein the defects on the metal strip are classified and counted in relation to size and shape of each defect.

6. The method according to claim 1, wherein the at least one of the pickling parameters is automatically changed using one of: i) a fuzzy evaluator, ii) a neural network, and iii) a neural fuzzy evaluator, the at least one of the pickling parameters being automatically changed as a function of defects on the metal strip to improve the pickling result, the defects including unpickled points of a material to be pickled off the metal strip.

7. The method according to claim 6, wherein one of the neural network and the neural fuzzy evaluator is used for automatically changing the at least one of the pickling parameters, the method further comprising:

setting by an operator of the pickling plant the pickling parameters;

comparing the pickling parameters set by the operator to pickling parameters determined by the one of the neural network and the neural fuzzy evaluator; and training the one of the neural network and the neural fuzzy evaluator to reduce a deviation between the pickling parameters set by the operator and the pickling parameters determined by the one of the neural network and the neural fuzzy evaluator.

8. The method according to claim 1, wherein the at least one of the pickling parameters is automatically changed using one of: i) a fuzzy evaluator, ii) a neural network, and iii) a neural fuzzy evaluator, and at least one of pickling parameters being automatically changed as a function of a classification of defects on the metal strip to improve the pickling result, the defects including unpickled points of a material to be pickled off the metal strip.

9. A system for pickling a metal strip, comprising a pickling plant through which the metal strip passes and whereby the metal strip is pickled by a pickling liquid; an instrument for measuring defects on the metal strip including unpickled points; and a means for classifying and counting said defects.

10. A system according to claim 9 further comprising an evaluator selected from the group consisting of a fuzzy evaluator, a neural network, and a neural fuzzy evaluator.

* * * * *